US006269706B1

(12) United States Patent
Kuragaki et al.

(10) Patent No.: US 6,269,706 B1
(45) Date of Patent: Aug. 7, 2001

(54) STARTER AND ITS INSTALLATION METHOD

(75) Inventors: Akira Kuragaki; Shigeru Shiroyama; Koichiro Kamei; Hidekazu Katayama, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/461,289

(22) Filed: Dec. 15, 1999

(30) Foreign Application Priority Data

Jun. 10, 1999 (JP) ..... 11-164035

(51) Int. Cl.[7] ..... F02N 15/06

(52) U.S. Cl. ..... 74/7 A; 74/7 E; 74/7 C; 29/596; 335/131

(58) Field of Search ..... 74/7 A, 7 E, 7 C; 29/596; 335/131

(56) References Cited

U.S. PATENT DOCUMENTS 5,118,960 * 6/1992 Sasamoto ..... 290/48
5,839,318 * 11/1998 Kimura et al. ..... 74/7 R
5,901,604 * 5/1999 Sato et al. ..... 74/7 A

FOREIGN PATENT DOCUMENTS 10-122103 5/1998 (JP) .
10-159692 6/1998 (JP) .

* cited by examiner

*Primary Examiner*—Allan D. Herrmann
(74) *Attorney, Agent, or Firm*—Sughrue, Mion, Zinn, Macpeak & Seas, PLLC

(57) ABSTRACT

To fully secure the precision around an output shaft, an electromagnet is axially held in position between a center bracket and a front bracket which form an enclosing member for a starter.

7 Claims, 11 Drawing Sheets

FORWARD
BACKWARD
A
Z
M
X
Y
20t
1t
60e
20
51
50
3
3w
52
54
50e
3Pe
53
3P
60d
3e
3c
3y
1
3B
3r
3A
3b
1a
70c
2c
3a
2
3x
5b
2b
4t
2t
2a
9d
6
1y
23
9c
16
1x
8
4
17a
17b
7s
5a
7
7t
1F
17
1h
18
18c
30
17h
1z
1z
17c
34
35
31
1P
18a
18b
70b
11
10b
18b
1P
15
15h
33
10a
15a
11a
14
32
9b
9a
70a
11t
13
13a
12
40
16e
60a
41

STARTER AND ITS INSTALLATION METHOD

BACKGROUND OF THE INVENTION

1. Field of the Invention

The present invention relates to a starter for starting an engine.

2. Description of the Prior Art

FIG. 9 is a sectional view showing one example of a conventional starter disclosed in Japanese laid-Open Patent Application (Kokai) No. Hei 10-159692.

In FIG. 9, 1A is an output shaft. Coaxially arranged on this output shaft 1A are an electromagnet 2A, an overrunning clutch 30A provided with a pinion 30P adapted to engage with a ring gear 50A, a plunger 40A consisting of an inner plunger 4A and an outer plunger 4B, etc. A starter with this structure is generally called a coaxial type starter.

Reference numeral 12A is an armature of a DC motor and 16A is a shaft (a motor shaft). Numeral 18A is a deceleration mechanism for decelerating the torque of the shaft 16A and transmitting it to the output shaft 1A.

8A is a contact shaft which is supported by an internal gear member 17A of the deceleration mechanism 18A substantially parallel with the plunger 40A through a supporting hole 17*m*.

100 is a front bracket, 130 is a yoke, 400 is a rear bracket, and 800 is a shift plate which connects the outer plunger 4B to the contact shaft 8A.

The upper side from the central axis in FIG. 9 shows the state of a starter not in operation and the lower side from the central axis in FIG. 9 shows the state where the starter is in operation with an electromagnet turned ON and the pinion engages the ring gear.

In this starter, when an ignition switch is turned ON and an electric current flows to an exciting coil of the electromagnet 2A, the outer plunger 4B is attracted by an exciting core 2C of the electromagnet 2A. This conventional starter has such a structure that the outer plunger 4B is directly connected to the contact shaft 8A through the shift plate 800 and the contact shaft 8A also moves at the same time when the outer plunger 4B is attracted and moved by the exciting coil 2B. A coil spring 401 is disposed between the outer plunger 4B and the inner plunger 4A through a spring bearing member 401S. The inner plunger 4A is kept in the resting state because the coil spring 401 bends at the initial stage even when the outer plunger 4B starts the movement by attraction. Disposed in front of the inner plunger 4A through a shifter member 402 is an inner clutch 30B, which is also kept in the resting state while the inner plunger 4A is kept in the resting state. After a short interval when the outer plunger 4B starts the movement by attraction, a moving contact 80A mounted on the contact shaft 8A comes into contact with a stationary contact 80B disposed in a contact chamber ZA. When the moving contact 80A contacts with the stationary contact 80B, electric power is supplied from an external power source through a contact bolt 11A to start rotation of the armature 12A. When the output shaft 1A starts to turn through the deceleration mechanism 18A, the pinion 30P starts to move toward the ring gear 50A by the thrust generated in a helical spline portion 1B. Then, the crest and root of the pinion 30P agree and engage with those of the ring gear 50A. Thereafter, when the engine starts, the output shaft 1A is separated from the pinion 30P by the action of the overrunning clutch 30A and the pinion 30p runs idle. When the power supply to the exciting coil 2B is stopped, the pinion 30P is disengaged from the ring gear 50A by return springs 403, 404.

Further, the conventional electromagnet is assembled as shown in Japanese Laid-Open patent Application (Kokai) No. Hei 10-159692 etc. This is explained by taking the conventional starter as shown in FIG. 9 for instance. When the electromagnet 2A is mounted on the front bracket 100, a switch case 2*k* enclosing the exciting coil 2B is press-fitted direct or through another member such as rubber and resin to an electromagnet housing portion 110 of the front bracket 100.

As described above, the conventional electromagnet 2A of the starter is press-fitted to the electromagnet-housing portion 110 of the front bracket 1005 and assembled to control the radial movement, but since no axial control is provided, there is the possibility that the electromagnet 2A is caused to axially move by some vibration etc. and as a result, it gets out of the normal position (the switch-housing portion 110).

To prevent this problem, when the electromagnet 2A is mounted on the front bracket 100 according to a method as shown in FIGS. 10 and 11, the switch case 2K enclosing the exciting coil 2B is first inserted into the electromagnet housing portion 110. It is then fixed by crimping the open end G (the side of the deceleration mechanism 18A) of the front bracket 100 as shown by a mark F. According to this method, it is possible to prevent the electromagnet 2A from axially getting out of the normal position (the switch-housing portion 110) by crimping the open end G of the front bracket 100. However, in this case, there is added a process of crimping, and manufacturing costs are higher.

Also, when the inner components are assembled in the conventional starter as shown in FIG. 10, the overrunning switch 30A and a shaft section 1AK of the output shaft 1A on which the sliding surface (a helical spline) for the overrunning switch 30A is formed are first installed in the front bracket 100. Then, the electromagnet 2A is inserted into the switch-housing portion 110 of the front bracket 100 and secured in place by crimping. After this, it was necessary for a group of components pre-installing the plunger 4*a*, the deceleration mechanism 18A including a flange section 1AF of the output shaft 1A, and a contact chamber ZA including the contact shaft 8A to be assembled as a unit (The starter of FIG. 9 is also assembled in the same manner as this).

Namely, in this case, it is necessary to use the shaft section 1AK and the flange section which are separated in advance for the output shaft 1A (Namely, as shown in FIG. 6, once the output shaft integrally provided with a shaft section and a flange section is assembled first, it is impossible to coaxially mount the overrunning clutch 30A, the electromagnet 2A, the plunger 4*a*, etc. on the output shaft 1A).

In this case, when the output shaft 1A is formed by combining the shaft section 1AK with the flange section 2AF, press fitting or crimping is the only way to combine them each other. Since this causes the eccentricity of the shaft by deformation, it is difficult to secure the accuracy of squareness etc. of the shaft portion lAK and the flange portion 1AF. There is also a problem that the accuracy around the output shaft of the starter cannot be secured.

SUMMARY OF THE INVENTION

It is therefore an object of the present invention to solve such problems as mentioned above and to provide a starter which does not require any extra process (a crimping process) and can reduce manufacturing costs as well.

It is another object to provide a starter in which the precision around an output shaft is fully secured and further provide a manufacturing method of the starter which can realize the objects as described above.

According to the present invention, a starter is provided in which an electromagnet is axially held in position between a center bracket and a front bracket which serve as an enclosing member for the starter.

Also, a starter installation method according to the present invention comprises the steps of:

(1) mounting an output shaft integrally formed with the shaft section and the flange section on a motor through a deceleration mechanism which is combined with the flange section;

(2) coaxially mounting a plunger on the output shaft;

(3) mounting a center bracket with an electromagnet built-in;

(4) spline-connecting an overrunning clutch to the output shaft;

(5) fitting a front bracket into a center bracket in such a condition where the electromagnet is held between the front bracket and the center bracket; and securing the front bracket and the center bracket in the axial direction by fastening a bolt so that the electromagnet can be secured between the front bracket and the center bracket.

The above and other objects, features and advantages of the present invention will become more apparent from the following description when taken in conjunction with the accompanying drawings.

BRIEF DESCRIPTION OF THE ACCOMPANYING DRAWINGS

Figure 7A:
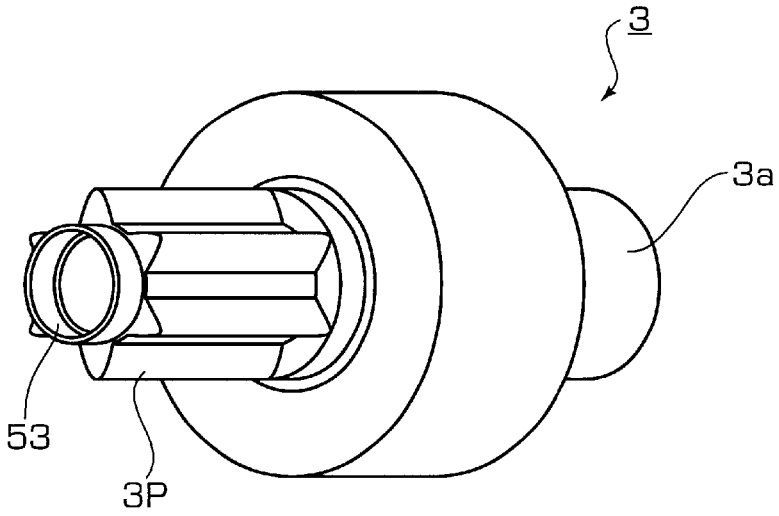
Figure 7B:
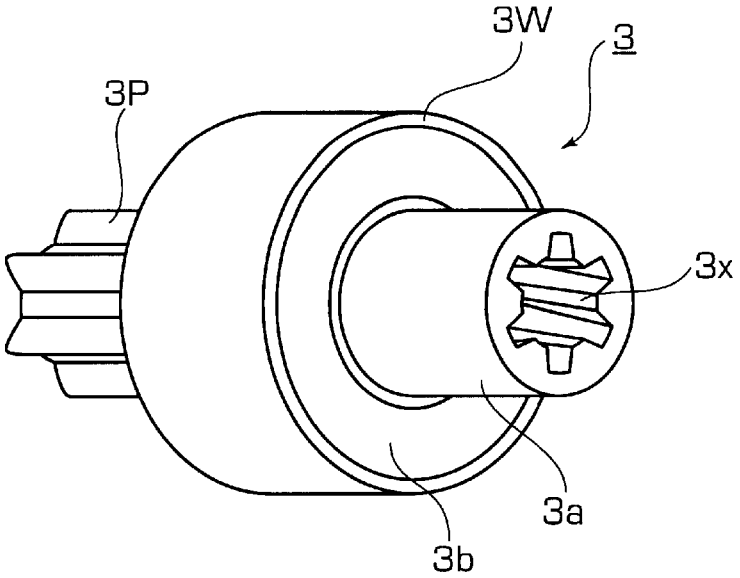
Figure 8:
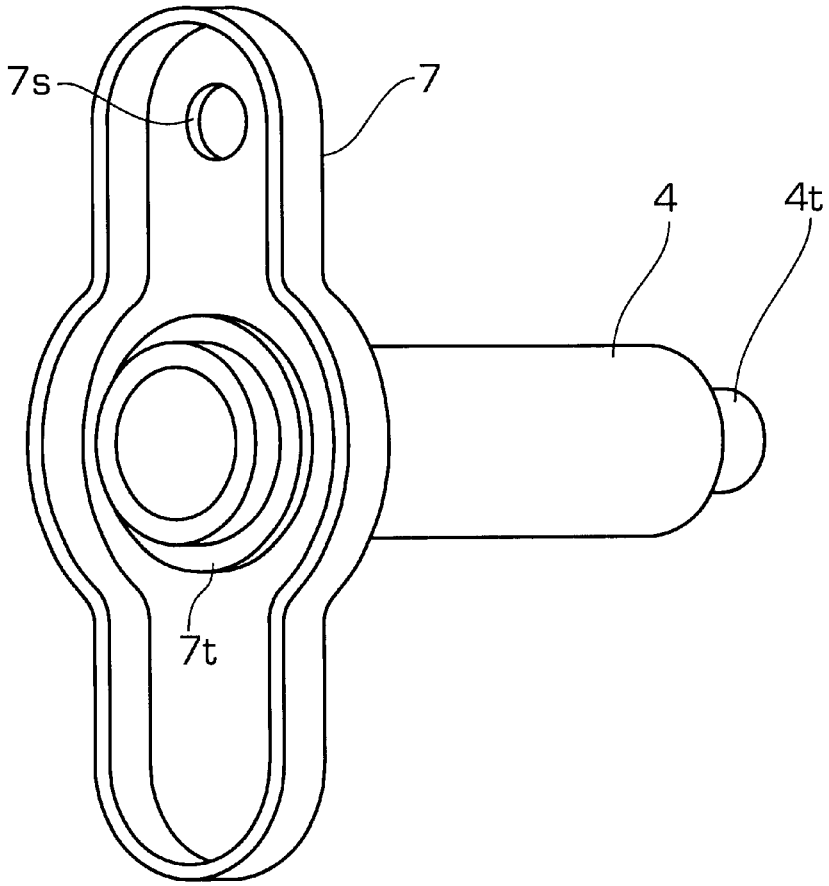
Figure 9:
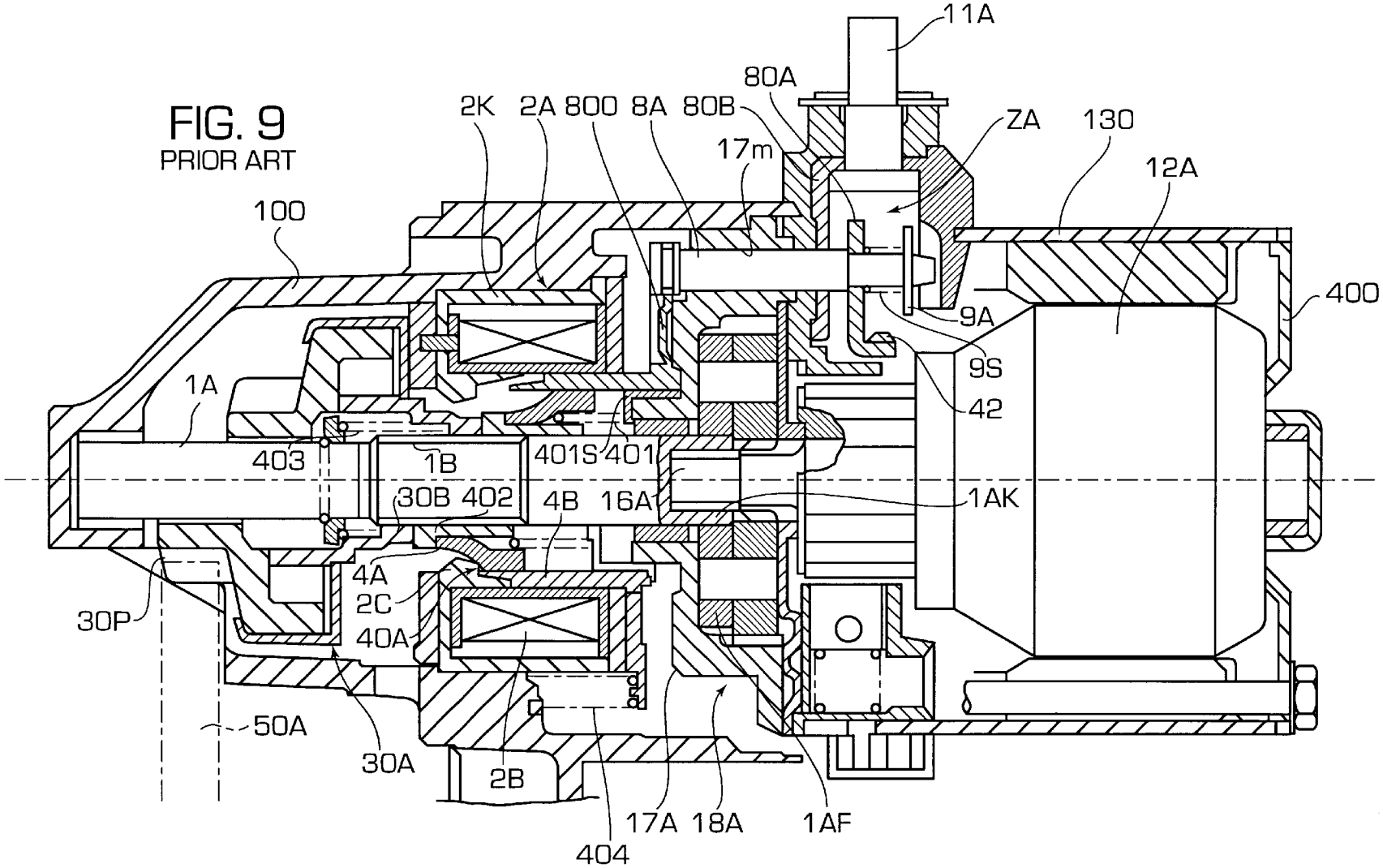
FIG. 9 PRIOR ART
Figure 10:
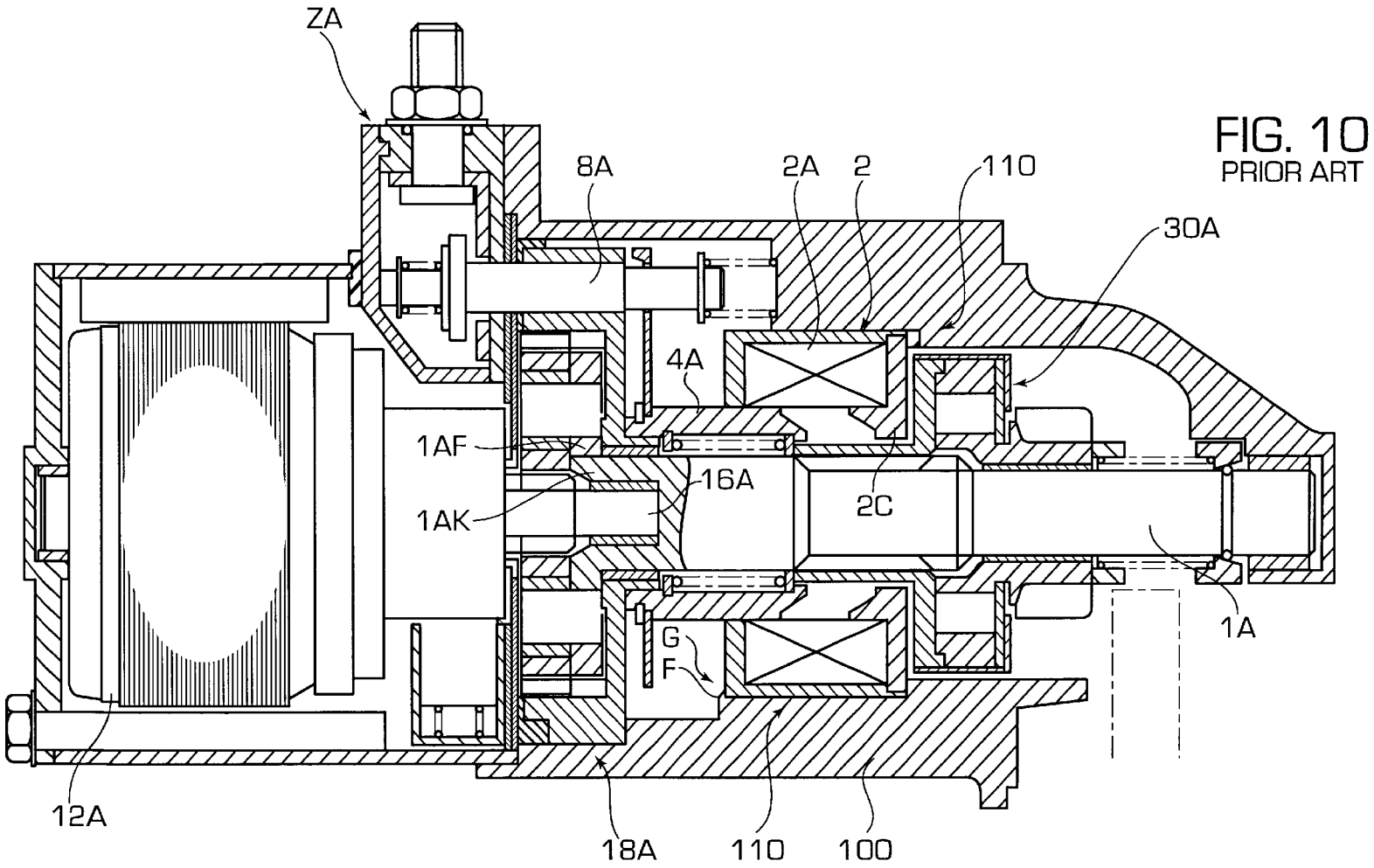
FIG. 10 PRIOR ART
Figure 11:
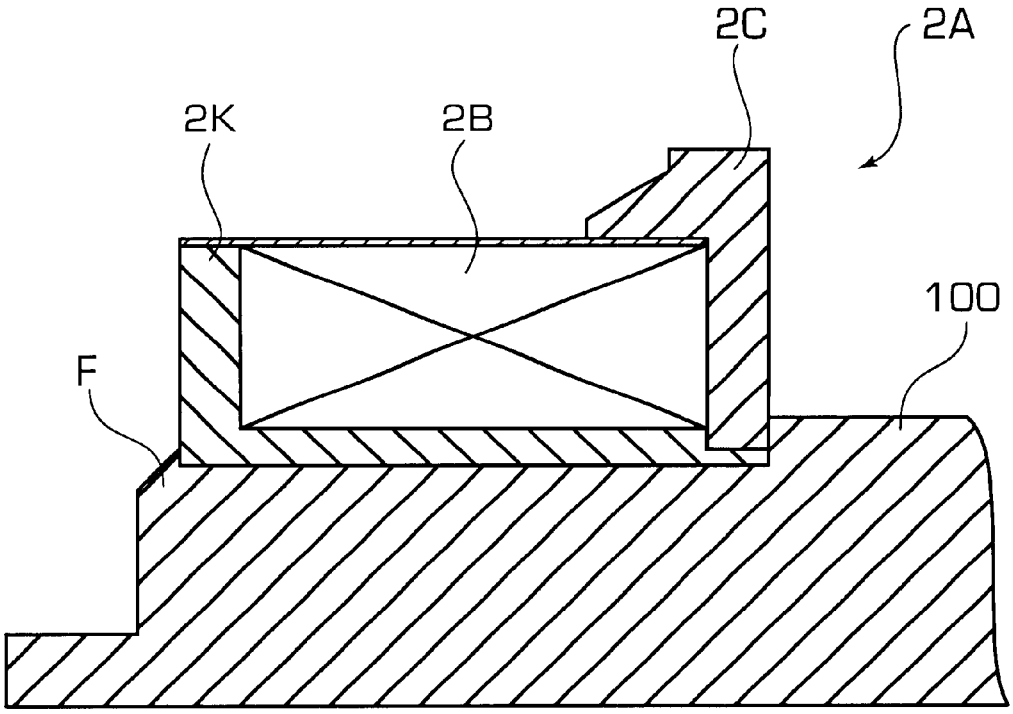
FIG. 11 PRIOR ART

FIG. 7(*a*) and (*b*) are perspective views of the overrunning clutch;

FIG. 8 is a perspective view of a plunger and a shift plate;

FIG. 9 is a cross-sectional view showing one example of a conventional starter;

FIG. 10 is a cross-sectional view for explaining an installation method of an electromagnet of the conventional starter; and FIG. 11 is an enlarged view showing an important part of FIG. 10.

DESCRIPTION OF THE PREFERRED EMBODIMENTS

1st Embodiment

A first embodiment of a starter according to the present invention will be explained hereunder with reference to the accompanying drawings.

Figure 1:
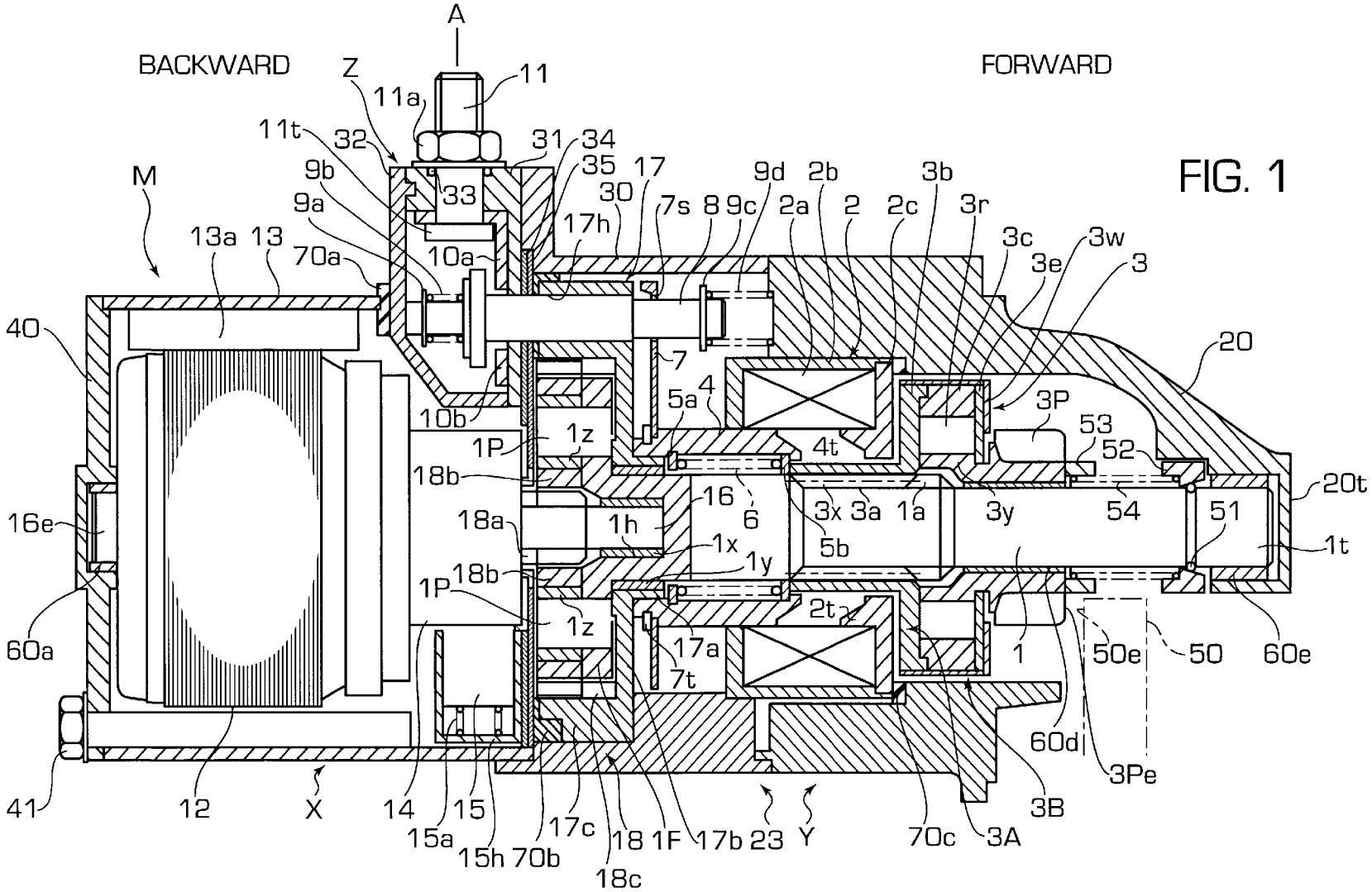
FIG. 1 is a cross-sectional view showing the structure of a starter according to a first embodiment of the present invention.

FIG. 1 is a cross-sectional view showing a structure of the starter according to a first embodiment. The left side of FIG. 1 is a DC motor section X, the right side is an operating section Y, and the upper portion of the substantially central side is a contact chamber Z, respectively. The motor side of FIG. 1 is referred to as the rear and the side of a ring gear is referred to as the front in the following explanation for convenience.

The starter according to the first embodiment is covered by such outer peripheral members for the starter as a front bracket 20, a center bracket 30, a yoke 13 and a rear bracket 40 and presents the substantially bullet-shaped external appearance. A portion into which a ring gear 50 is inserted is an opening.

In the starter, there are arranged a DC motor M and an output shaft 1 driven by this DC motor M. Arranged around this output shaft 1 are an annular electromagnet 2, an overrunning clutch 3, a plunger (a movable core) 4, etc.

In other words, the starter according to the first embodiment is a coaxial type starter with the electromagnet 2, the overrunning clutch 3 and the plunger 4 coaxially arranged on the output shaft 1.

The starter according to the first embodiment will be assembled as follows.

The contact chamber Z including a contact shaft 8 is secured to the pre-assembled DC motor section X. Then, the output shaft 1 is secured to a shaft 16 of the motor through the deceleration mechanism 18. The plunger 4 including a shift plate 7 is coaxially secured on the output shaft 1. The center bracket 30 with the electromagnet 2 built-in is coaxially secured on the output shaft 1. Then, the overrunning clutch 3 is spline-connected to the output shaft 1. Thereafter, the front bracket 20 is caused to engage with the center bracket 30 through an engaging portion 23 for final fastening by a through-bolt 41.

By fastening the through-bolt 41, the DC motor section X and the operating section Y are fixedly held in position between the rear bracket 40 and the front bracket 20 and thus the assembling of the starter is completed. When the through-bore 41 is fastened, the axial force is caused to axially secure the front bracket 20 and the center bracket 30 and as a result, the electromagnet 2 disposed between both brackets 20 and 30 is held in position. Thus, the electromagnet 2 is firmly secured both axially and radially and the axial misregistration is not caused even in case of vibration etc.

Figure 2:
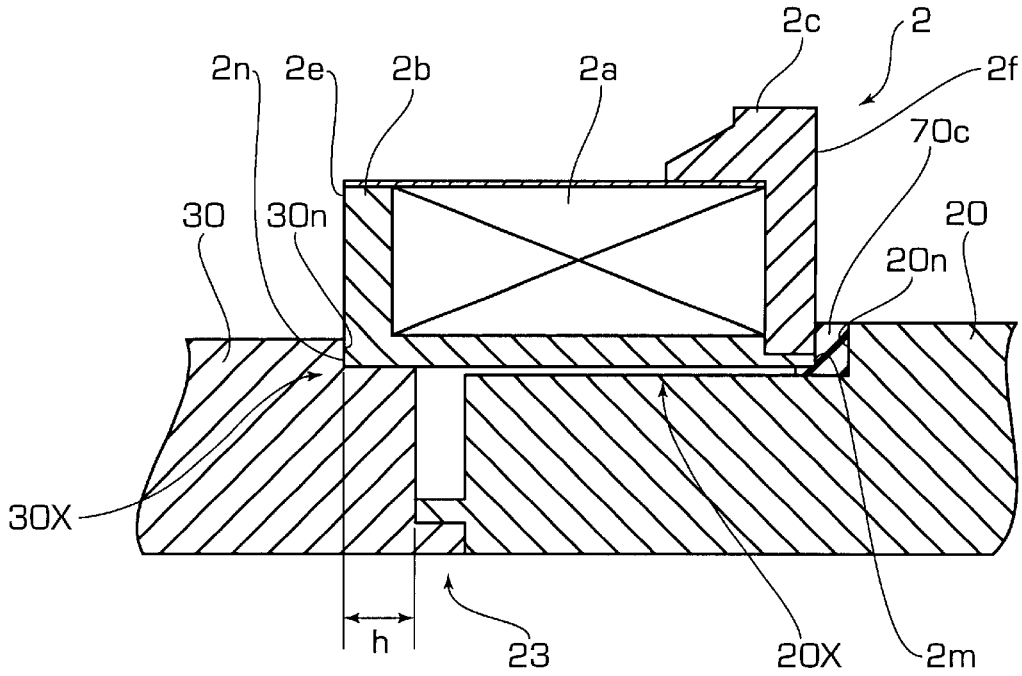
FIG. 2 is an enlarged view showing an important part of FIG. 1.

In other words, an exciting coil 2*a* and an exciting core 2*c* are enclosed by a switch case 2*b*. The cylindrical and pre-assembled electromagnet 2 which is coaxially arranged on the output shaft 1 is firmly held in position between a recess 30*x* formed on the center bracket 30 and a recess 20X formed on the front bracket 20 as shown in FIG. 2.

Also, a peripheral side 2*n* of one end 2*e* of the electromagnet 2 is caused to come in direct contact with a wall surface 30*n* of the recess 30X of the center bracket 30. A peripheral side 2*m* in the other end 2*f* is arranged to contact with a wall surface 20*n* of the recess 20X through a rubber packing 70*c* serving as a cushioning material.

Specifically, a section of the center bracket 30 corresponding to the peripheral side of one end of the electromagnet 2 is formed with the recess 30X adapted to control the movement of the electromagnet 2 in both axial and radial directions. The electromagnet 2 is pre-installed in the center bracket 30 by press-fitting one end 2*e* of the electromagnet 2 within this recess 30 X by means of an exclusive press-fitting machine. Also, as shown in FIG. 1, this recess 30X is formed except the section where the contact shaft 8 is arranged.

Thus, the electromagnet 2 is finally assembled by causing the peripheral side 2*m* of the other end 2*f* of the electromagnet 2 to contact with the wall surface 20*n* of the recess 20X of the front bracket 20 through the rubber packing 70*c* and then fastening the through-bolt.

According to the first embodiment, it is possible to easily assemble the electromagnet 2 without adding any caulking (crimping) process and without axial misregistration, and further possible to reduce the manufacturing cost.

Figure 6:
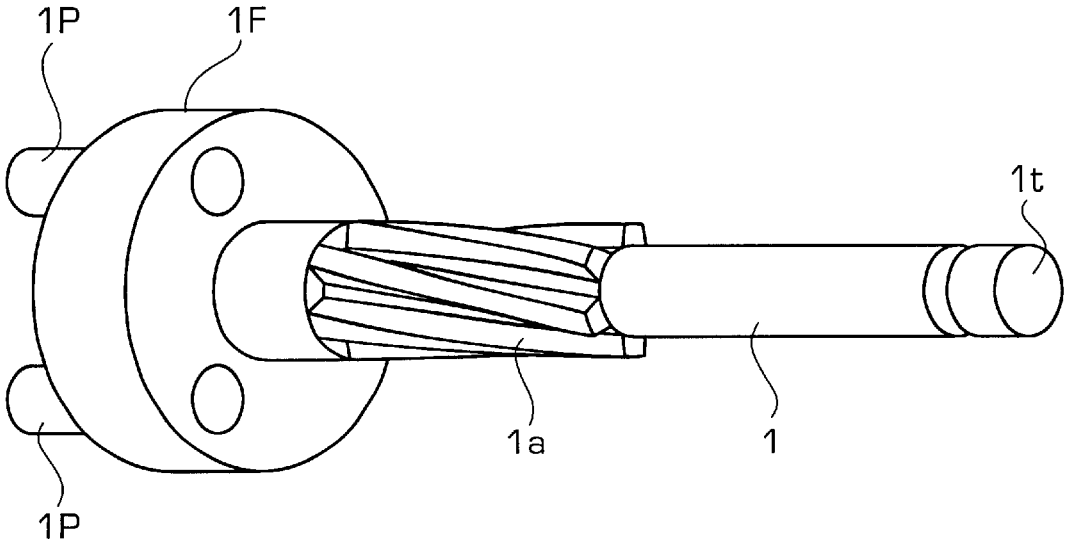
FIG. 6 is a perspective view of an output shaft.

Although the conventional starter has only one front bracket, there are provided two independent brackets of the front bracket 20 and the center bracket 30 in the present embodiment so that the electromagnet 2 can be installed from the front side of the output shaft 1. Accordingly, it is no longer necessary to divide the output shaft 1 into two sections of a shaft section which is provided with a helical spline 1*a* for causing a thrust spline 3A of an overrunning clutch 3 to slide thereon, and a flange section forming the deceleration mechanism. As shown in FIG. 6, it is possible to use the output shaft 1 which is integrally formed with the flange section 1F. Therefore, it is possible to secure the precision around the output shaft 1 and in particular, possible to fully secure the squareness between the shaft section and the flange section 1F and further possible to secure a reliable starter.

The peripheral side 2*m* of the other end 2*f* of the electromagnet 2 is arranged to come into contact with the front bracket 20 through the rubber packing 70*c*. It is therefore possible to hold both the electromagnet 2 and the front bracket 20 in position even when there is a little axial error in the geometry of the electromagnet 2 or the dimension of the recess 20X formed on the front bracket 20.

Since the electromagnet 2 is secured in position through the rubber packing 70*c*, it is advantageous to vibration proof.

Further, since the press-fitting overlap width h for controlling the periphery of the electromagnet 2 in the radial direction can be shortened, it is not necessary to increase the capacity of the press-fitting machine over and above what is wanted.

2nd Embodiment

Figure 3:
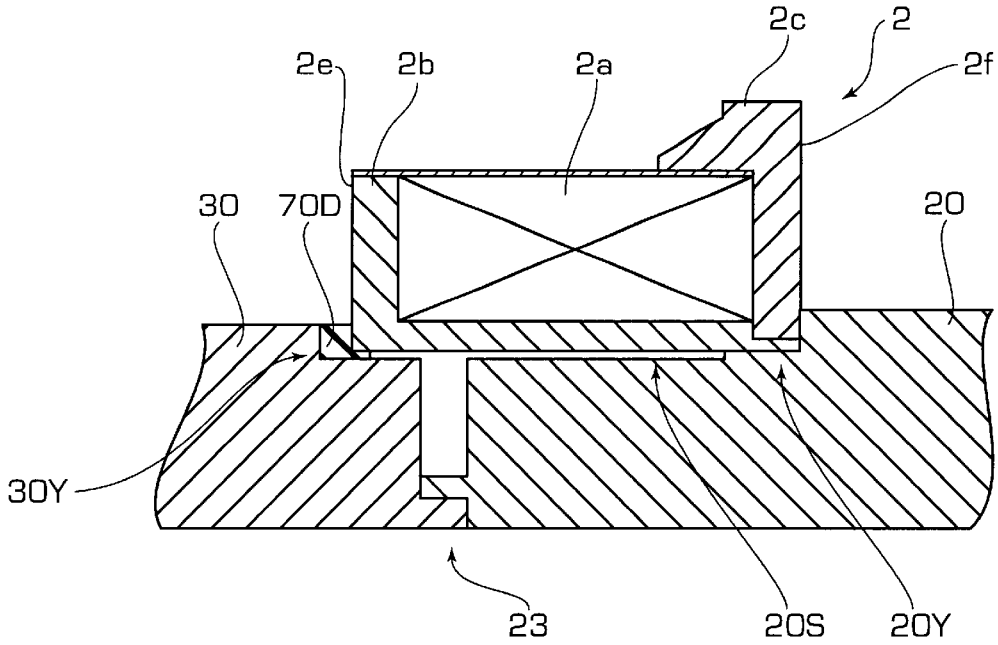
FIG. 3 is an enlarged view of an important part of the starter according to a second embodiment of the present invention.

As shown in FIG. 3, it is also possible to cause the other end 2*f* of the electromagnet 2 to come into direct contact with the front bracket 20 and secure one end 2*e* to the center bracket 30 through a packing 70*d*.

In other words, the peripheral side of one end 2*e* of the electromagnet 2 is held in the recess 30Y of the center bracket 30 through the rubber packing 70*d*.

Then, the section of the front bracket 20 corresponding to the peripheral side of the other end 2*f* of the electromagnet 2 is provided with a recess 20Y adapted to control the movement of the electromagnet 2 in both the axial and radial directions. The other end 2*f* of the electromagnet 2 is press-fitted into the recess 20Y by means of the exclusive press-fitting machine and thus the front bracket 20 is secured to the electromagnet 2.

The electromagnet 2 is finally kept in position by fastening the through-bolt 41.

It is to be noted that the second embodiment can get the same effect as the first embodiment.

When the above-mentioned first and second embodiments are put into practice, to assure the positioning of the electromagnet 2 in the radial direction, it is desirable to press-fit the periphery of a switch case on the end of the electromagnet 2 coming in direct contact with the bracket into the recess formed on the bracket. However, when the press-fitting overlap width h is too large, it is inevitable to increase the capacity of the press-fitting machine over and above what is wanted. Therefore, when the axial press-fitting overlap width is longer, as shown in FIG. 3, it is efficient to make a section 20S of the bracket recess larger than the periphery of the switch case 2*b* in advance.

It is also possible to use other materials such as resin for the cushioning materials in addition to the rubber.

The starter according to the present invention will now be described in detail below with reference to FIG. 1 and FIGS. 4 through 8.

As is well known, the DC motor comprises an armature 12, a yoke 13 enclosing the armature 12, a stationary magnetic pole 13*a* disposed inside this yoke 13, a commutator 14, brushes 15, and a shaft 16. The armature 12 is an armature core with an armature coil wound round it. The front side of the shaft 16 penetrates the cylindrical space of the cylindrical commutator 14 and is connected to a deceleration mechanism 18.

The armature coil is connected to the commutator 14. The DC motor is available in 2-pole, 4-pole and 6-pole types depending on the number of the stationary magnetic poles. For instance, taking the case of using a 6-pole DC motor as a sample, a total of 6 units of the stationary magnetic pole 13*a* by arranging a N-pole and a S-pole alternately. The brushes 15 kept in contact with the commutator 14 are arranged along the circumference of the commutator 14.

Reference numeral 15*a* is a spring that pushes the brushes 15 against the commutator 14. Numeral 15*h* denotes a brush holder.

The DC motor M as described above drives an output shaft 1.

The operating section Y comprises a deceleration mechanism 18, the output shaft 1, an electromagnet 2, an overrunning clutch 3, and a plunger 4. etc.

17 is an inner gear member. This member comprises a first tubular portion 17*a* fitted to the outer circumference of the output shaft 1 through a bearing 1*y*, a hollow disk-shaped bottom plate portion 17*b* extending in the direction perpendicular to the outer circumference of the output shaft 1 from the first tubular portion 17*a*, and a second tubular portion 17*c* extending in the rear side from the outer circumference edge of the bottom plate portion 17*b* and having an inner gear 18*c* on the inner circumference.

The deceleration mechanism 18 comprises the inner gear 18*c* of the inner gear member 17, a sun gear 18*a* provided on the shaft 16, a plurality of planet gears 18*b* arranged around this sun gear 18*a* and engaging with the sun gear 18*a* and the inner gear 18*c*, and pins 1P which projects from a flange section 1F of the output shaft 1 inserted between the group of planet gears 18*b* and the bottom plate portion 17*b* of the inner gear member 17 and connects each of the planet gears 18*b* to the flange section 1F of the output shaft 1. The rotational force of each planet gear 18*b* is transmitted to each pin 1*p* through a bearing 1*z*.

A round groove 1*h* is formed at the center of the flange portion 1F of the output shaft 1 and the forward end of the shaft 16 is rotatably supported through a bearing 1*x* provided in the round groove 1*h*.

Figure 4:
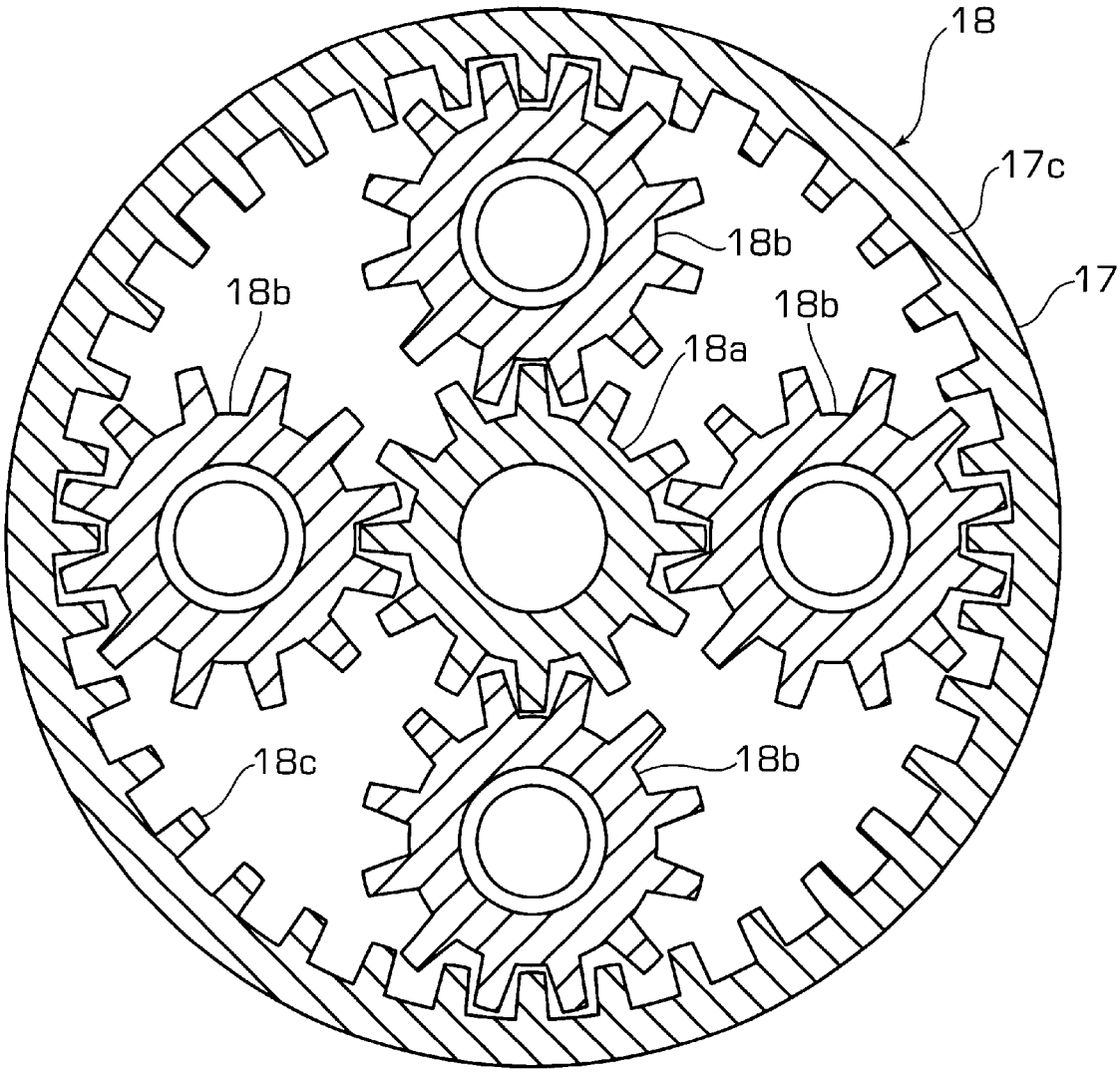
FIG. 4 is cross-sectional view of a deceleration mechanism.

Accordingly, as shown in the cross-sectional view of FIG. 4, when each planet gear 18*b* moves around the sun gear 18*a*, the rotational force of the shaft 16 is decelerated and transmitted to the output shaft 1 through the pins 1P.

A helical spline 1*a* is formed on a part of the outer circumference at the central side of the output shaft 1. On the outer circumference of the part where this helical spline 1*a* is formed, the overrunning clutch 3 is arranged so that a tubular portion 3*a* of a thrust spline 3A corresponds thereto. Further, formed on the inner surface of the tubular portion 3*a* of the thrust spline 3A is a helical spline 3*x* to engage with the helical spline 1*a*. That is, the overrunning clutch 3 is spline-connected to the output shaft 1.

The electromagnet 2 is arranged on the outer circumference of the tubular portion 3*a* of the thrust spline 3A.

The plunger 4 is arranged on the outer circumference on the flange 1F side of the output shaft 1.

The overrunning clutch 3 comprises the thrust spline 3A provided with a tubular portion 3*a* and a flange portion 3*b*, a roller cam 3*c*, a pinion 3P, an inner clutch 3*y*, a clutch roller 3*r* and a spring 3*s*, and a clutch cover 3*w*. The tubular portion 3*a* of the thrust spline 3A is provided on the inner surface with the helical spline 3*x* adapted to engage with the helical spline 1*a* formed on a part of the outer circumference on the central side of the output shaft 1. The flange portion 3*b* is formed on the front side of the tubular portion 3*a* and serves as the cam bottom of the roller cam 3*c*. The roller cam 3*c* is kept in position between the flange portion 3*b* and a washer 3*e* of the thrust spline 3A. The inner clutch 3*y* forms a tubular portion of the base of the pinion 3P. The clutch roller 3*r* and the spring 3*s* are disposed in a groove 3*t* formed on the roller cam 3*c*. The clutch cover 3*w* is arranged to cover the outside of the flange portion 3*b*, the roller cam 3*c* and the washer 3*e* of the thrust spline 3A.

The thrust spline 3A and the roller cam 3*c* form an outer clutch 3B.

Figure 5:
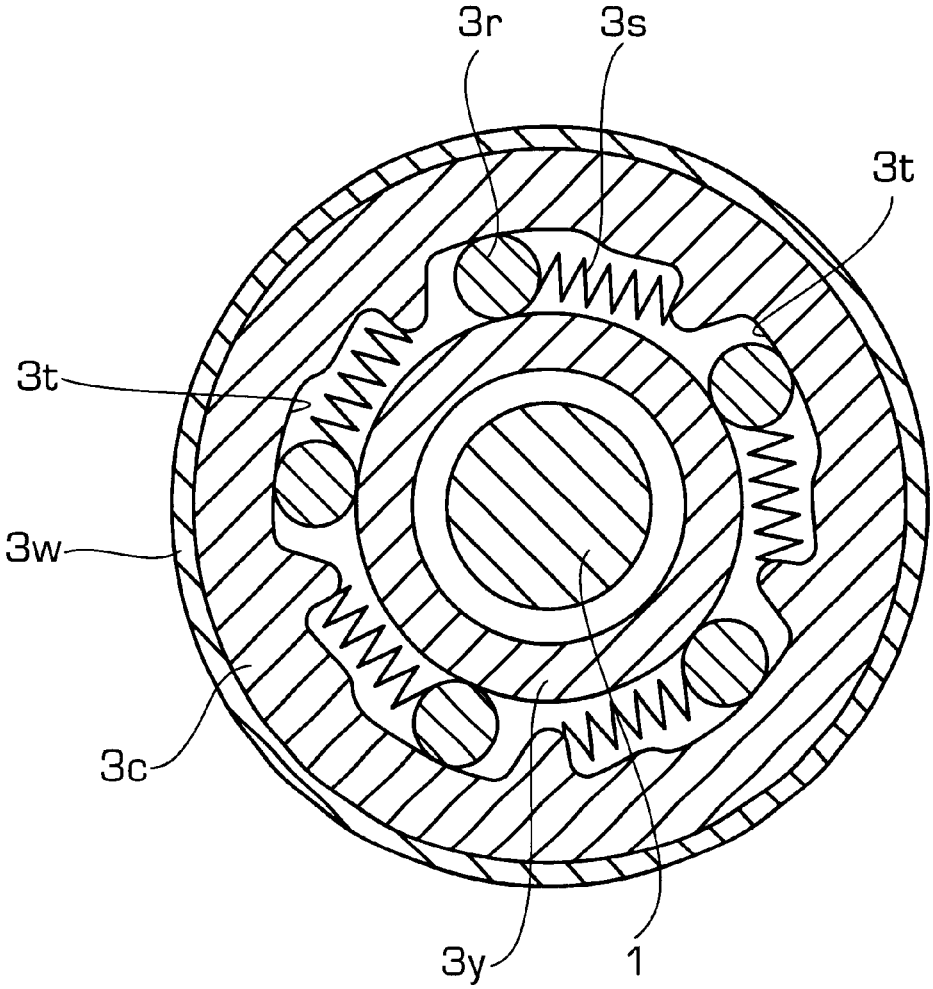
FIG. 5 is a cross-sectional view of an overrunning clutch.

The overrunning clutch 3 acts as a so-called one-way clutch. FIG. 5 shows a cross-sectional view of the overrunning clutch 3. Formed at several points on the inner circumference of the roller cam 3*c* are grooves 3*t* which form a narrow space and a wide space between the inner circumference of the roller cam 3*c* and the outer circumference of the inner clutch 3*y*. The clutch roller 3*r* is disposed in each of the grooves 3*t*. 3*s* is the spring for pressing the clutch roller 3*r* toward the narrow space of the grooves 3*t*.

When the output shaft 1 is driven by the DC motor M, the roller cam 3*c* is caused to rotate to move the clutch roller 3*r* toward the narrow space. Then, the roller cam 3*c* of the outer clutch 3B engages with the inner clutch 3*y* to rotate the pinion 3P, which engages with a ring gear 50. Once the pinion 3*p* is rotated by the ring gear 50, the clutch roller 3*r* is caused to move toward the wide space of the grooves 3*t*, and the outer clutch 3B and the inner clutch 3*y* are disengaged to separate the overrunning clutch 3 from the engine.

The electromagnet 2 comprises the exciting coil 2*a*, the switch case 2*b* for covering the exciting coil 2*a*, and the core 2*c*, and is arranged at the rear side of the position of the overrunning clutch 3B. The core 2*c* has a hollow-shaped disc surface opposing the flange portion 3*b* of the thrust spline 3A and is made in the annular body arranged so as to penetrate the outer circumference of the tubular portion 3*a* of the thrust spline 3A. The core 2*c* also has annular projection 2*t* extending to the rear side at the tubular portion 3*a* side of the thrust spline 3A.

The plunger 4 is made of a tubular body that is arranged in a movable manner between the inner circumference of the switch case 2*b* and the tubular portion 3*a* of the thrust spline 3A. The front end 4*t* of the plunger 4 opposing the annular projection 2*t* of the core 2*c* is formed in a shape corresponding to the shape of the annular projection 2*t*. An annular plate 5*a* serving as a first pressing plate is secured on the inner circumference on the rear end of the plunger 4. In addition, an annular plate 5*b* serving as a second pressing plate is provided on the rear end of the tubular portion 3*a* of the thrust spline 3A of the overrunning clutch 3. Arranged between these plates 5*a* and 5*b*, that is, between the inner circumference of the plunger 4 and the outer circumference of the output shaft 1 is a coil spring 6 serving as an elastic means.

Accordingly, the plunger 4 is attracted by the core 2*c* to move in the direction (forward) of the core 2*c*, and the overrunning clutch 3 moves as pushed by the plate 5*b* with the movement of the plunger 4. When the pinion 3P once stops moving after the end surface is brought into contact with the end surface of the ring gear 50, the motor is driven. When the crests and roots of the pinion 3P fit those of the ring gear 50, the pinion 3P engages with the ring gear 50 by the elastic force of the coil spring 6.

8 is a contact shaft which is movably supported in the extended direction of the shaft by a supporting hole 17*h* provided on a part (the upper part in FIG. 1) of a second tubular portion 17*c* of the inner gear member 17. Further, the contact shaft 8 is mounted so as to extend over the operating section Y and the contact chamber Z through the supporting hole 17*h*.

A movable contact 8*e* is provided at one end of the contact shaft 8 situating within the contact chamber Z. At the rear side of this movable contact 8*e*, an annular plate 9*a* is secured to the contact shaft 8, and there is provided a coil spring 9*b* for pressing the movable contact 8*a* to the stationary contact (described later) side between the plate 9*a* and the movable contact 8*e*. At the other end of the shaft situating on the side of the operating section Y, an annular plate 9*c* is secured to the contact shaft 8, and there is provided a return coil 9*d* between the plate 9*c* and the front bracket 20.

Further, a shift plate 7 is mounted on the rear end of the plunger 4. This shift plate 7 is an elongated plate extending in the upper and lower directions with a hole formed on the center side for mounting on the rear of the plunger 4 and a through-hole 7*s* on the upper portion corresponding to the contact shaft 8. This shift plate 7 is secured to the plunger 4 with an engaging ring 7*t*.

The DC motor section X, the contact chamber Z and the operating section Y are divided by partition plates 34, 35.

Also, the contact chamber Z is divided by a contact chamber wall 31 and a contact chamber cover 32. The contact chamber wall 31 is provided with a first stationary contact 10*a* and a second stationary contact 10*b*.

The first stationary contact 10*a* is connected to a battery through a terminal bolt 11.

The second stationary contact 10*b* is connected to the positive pole brushes through a lead wire and is also connected to the other end of the exciting coil 2*a* of the electromagnet 2.

In the state where the terminal bolt 11 is secured in potion by a nut ha, the first stationary contact 10*a* is also secured to the contact chamber wall 31 by the bolt head 11*t*.

33 is an O-ring and 70*b* is a packing.

A rear end 16*e* of the shaft 16 is rotatably supported on a rear bracket 40 through a bearing 60*a*, and a front end it of the output shaft 1 is supported on the tip 20*t* side of the front bracket 20 through a bearing 60*e*.

Provided on the front side of the output shaft 1 through an engaging ring 51 is a stopper 52. Also, a stopper 53 is provided on the tip of the pinion 3P. Between these stoppers 52 and 53, there is provided a return spring 54.

FIG. 6 shows a perspective view of the output shaft 1, FIG. 7(*a*) and (*b*) show a perspective view of the overrunning clutch 3, and FIG. 8 shows a perspective view of the plunger 4 and shift plate 7, respectively.

Next, the operation will be described.

When the ignition switch is turned ON and current flows to the exciting coil 2*a* of the electromagnet 2, the plunger 4 is attracted toward the exciting core 2*c*, the plate 5*a* pushes the coil spring 6, and the plate 5*b* presses the thrust spline 3A to push the overrunning clutch 3 out toward the ring gear 50. As a result, as the end surface 3P*e* of the pinion 3P provided at the overrunning clutch 3 is brought into contact with the end surface 50*e* of the ring gear 50, the movement of the overrunning clutch 3 in the forward direction stops for a while. However, while the plate 5*a* provided on the inner circumferential side of the plunger 4 compresses the coil spring 6, the plunger 4 is further attracted and continues to move. The shift plate 7 also moves forward and contacts the plate 9*c*.

After this state, the plunger 4 is continuously attracted and the plate 9*c* secured to the contact shaft 8 is pushed by the shift plate 7 to cause the contact shaft 8 to move forward. As a result, when the movable contact 8*e* of the contact shaft 8 is brought into contact with the first and second stationary contacts 10*a*, 10*b*, electric power is supplied from a battery and the armature 12 begins to rotate.

The contact shaft 8 continuously moves until the plunger 4 is completely attracted and its front end 4*t* is brought into contact with the exciting core 2*c*. At this time, the coil spring 9*b* is compressed by the plate 9*a* and thus, the movable contact Be is pressed and kept in contact with the first and second stationary contacts 10*a*, 10*b*.

When the armature 12 begins to rotate, the rotational force is decelerated through the deceleration mechanism 18 and is transmitted to the output shaft 1, the overrunning clutch 3 that is spline connected to the output shaft 1, and further to the pinion 3P. Then, when the pinion 3P turns slowly and the crests and roots of the pinion 3P agree with those of the ring gear, the pinion 3P is pushed forward by the spring force (the elastic force) of the compressed coil spring 6 and completely engages with the ring gear 50. Thus, as a crankshaft connected to the ring gear 50 turns, the engine is started.

When the engine is started, the output shaft 1 is separated from the pinion 3P by the action of the overrunning clutch 3 and the pinion 3P runs idle. Then, when the power supply to the exciting coil 2*a* is stopped, the pinion 3P is disengaged from the ring gear 50 as the plunger 4 and the overrunning clutch 3 are returned to their original positions by the return coil springs 9*d* and 54.

Further, when the crests and roots of the pinion 3P agree with those of the ring gear 50, the end surface 3P*e* of the pinion 3P is not brought into contact with the end surface 50*e* of the ring gear 50, but the pinion 3P engages with the ring gear without any problem.

As described above, according to the starter and the starter installation method according to the present invention, it is possible to reduce the manufacturing cost of the starter and fully secure the precision around the output shaft.

What is claimed is:

1. A starter having an output shaft driven by an electric motor, comprising:

a plunger, an electromagnet provided with an exciting coil, and an overrunning clutch which are coaxially arranged on the output shaft, the exciting coil of the electromagnet being excited to attract the plunger for driving the motor, the overrunning clutch with a thrust spline which is spline-connected to the output shaft being moved toward a ring gear to cause a pinion provided on the overrunning clutch to engage with the ring gear for starting an engine; and wherein the electromagnet is axially held in position between a center bracket and a front bracket which form an enclosing member for the starter.

2. A starter according to claim 1, wherein one end surface of the electromagnet in the axial direction of the output shaft is brought into direct contact with either one of the center bracket or the front bracket, and the other end surface is secured to the other bracket through a cushioning member.

3. A starter according to claim 2, wherein an outer circumference on the end surface of the electromagnet directly contacting with the bracket is press-fitted to the bracket.

4. A starter according to claim 1, wherein the output shaft is integrally provided with a shaft section, and a flange section for receiving the rotational force of the motor through a deceleration mechanism.

5. A starter according to claim 2, wherein the output shaft is integrally provided with a shaft section, and a flange section for receiving the rotational force of the motor through a deceleration mechanism.

6. A starter according to claim 3, wherein the output shaft is integrally provided with a shaft section, and a flange section for receiving the rotational force of the motor through a deceleration mechanism.

7. A method of assembling a starter according to claim 4, comprising the steps of:

(1) mounting the output shaft which is integrally provided with the shaft section and the flange section, on the motor through the deceleration mechanism which is adapted to combine with the flange section;

(2) coaxially mounting the plunger on the output shaft;

(3) mounting the center bracket with the electromagnet built-in;

(4) spline-connecting the overrunning clutch to the output shaft;

(5) fitting the front bracket into the center bracket in such a condition where the electromagnet is held in position between the front bracket and the center bracket; and (6) securing the front bracket and the center bracket in the axial direction by fastening a bolt so that the electromagnet can be secured between the front bracket and the center bracket.

* * * * *